US007207644B2

(12) United States Patent
Kaburagi

(10) Patent No.: US 7,207,644 B2
(45) Date of Patent: Apr. 24, 2007

(54) PRINTING APPARATUS AND PRINTING CONTROL METHOD FOR CONTROLLING THE NUMBER OF PRINTING ELEMENTS USED IN PRINTING

(75) Inventor: Yoshiaki Kaburagi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 242 days.

(21) Appl. No.: 10/706,941

(22) Filed: Nov. 14, 2003

(65) Prior Publication Data

US 2004/0227781 A1 Nov. 18, 2004

(30) Foreign Application Priority Data

Nov. 22, 2002 (JP) ..... 2002-339753
Oct. 22, 2003 (JP) ..... 2003-361941

(51) Int. Cl.
*B41J 29/38* (2006.01)

(52) U.S. Cl. ..... 347/19; 347/9; 347/14; 347/37

(58) Field of Classification Search ..... 347/19, 347/14, 37, 9
See application file for complete search history.

(56) References Cited

U.S. PATENT DOCUMENTS 4,313,124 A 1/1982 Hara
4,345,262 A 8/1982 Shirato et al.
4,463,359 A 7/1984 Ayata et al.
4,723,129 A 2/1988 Endo et al.
4,740,796 A 4/1988 Endo et al.
5,617,122 A * 4/1997 Numata et al. ..... 347/14
5,690,437 A * 11/1997 Yanagisawa et al. .. 400/120.14
6,481,905 B2 * 11/2002 Day et al. ..... 400/88
6,719,396 B2 * 4/2004 Anzai ..... 347/19
6,761,426 B2 * 7/2004 Tsuchiya et al. ..... 347/19
2001/0055042 A1 * 12/2001 Matsumoto et al. ..... 347/19
2002/0060707 A1 * 5/2002 Yu et al. ..... 347/19
2003/0067507 A1 * 4/2003 Anzai ..... 347/37
2003/0095161 A1 * 5/2003 Ohde ..... 347/19

FOREIGN PATENT DOCUMENTS

JP 9-226185 9/1997
JP 09226185 A * 9/1997

* cited by examiner

*Primary Examiner*—Manish S. Shah
*Assistant Examiner*—Laura E. Martin
(74) *Attorney, Agent, or Firm*—Fitzpatrick, Cella, Harper & Scinto

(57) ABSTRACT

Printing apparatus and printing control method capable of high-speed printing without enlarging the size of a carriage driving motor and/or a power source. In a printing apparatus employing the printing control method, a carriage to which a printhead having a plurality of printing elements is mounted is reciprocally scanned, and printing is performed on a printing medium during acceleration, deceleration, and constant-speed movement of the carriage. In such printing, print data for one scan is stored in a buffer, and at least a part of the print data, stored in the buffer, that causes the printhead to perform printing during carriage acceleration is counted. The counted value is compared with a predetermined threshold value. Based on the result of comparison, it is controlled to change the number of printing elements used in printing for one scan of the carriage.

8 Claims, 12 Drawing Sheets

PRINTING APPARATUS AND PRINTING CONTROL METHOD FOR CONTROLLING THE NUMBER OF PRINTING ELEMENTS USED IN PRINTING

CLAIM OF PRIORITY

This application claims priority under 35 U.S.C. § 119 from Japanese Patent Application No. 2002-339753, entitled "Printing Control Method" filed on Nov. 22, 2002, and Japanese Patent Application No. 2003-361941 entitled "Printing Apparatus and Printing Control Method" filed on Oct. 22, 2003, the entire contents of which are incorporated herein by reference.

FIELD OF THE INVENTION

This invention relates to a printing apparatus and a printing control method and, more particularly, to a printing apparatus and a printing control method for printing an image on a printing medium by scanning a printhead.

BACKGROUND OF THE INVENTION

Conventionally known printing apparatuses print characters, images and the like on a sheet material (printing medium), e.g., paper, plastic film or the like. Image forming processes adopted by these printing apparatuses include: a wire dot method, a thermal transfer method, an inkjet method, a laser beam method, and so forth.

A printing apparatus of this type includes a serial printing type which performs printing by scanning a carriage incorporating a printhead, a line printing type which performs printing in units of lines using a line-head, and a page printing type which performs printing in units of pages.

Among these printers, the serial-type inkjet printer forms an image on a printing medium by mounting an inkjet printhead (hereinafter referred to as a printhead) on a carriage, which is reciprocally moved in the longitudinal direction of a platen using a carriage motor as a driving source, and driving a plurality of printing elements provided in the printhead in synchronization with scanning of the carriage, thereby discharging ink from ink discharge nozzles (hereinafter referred to as nozzles) which correspond to the printing elements.

Along with recent demands for high-quality printing, high-density printheads become common. For instance, an inkjet printing apparatus comprising a printhead which has nozzles for 600 dots per inch (600 dpi) is widely used. Furthermore, printing media that can be us d in printing are expanded from inkjet-exclusive paper, e.g., coated paper, to plain paper. As such high-density printheads are prevailing, it has become a normal procedure to receive bitmap image data and print a graphic image, or to receive image data sensed by a digital camera and print a photograph image.

Furthermore, in order to meet the recent demands for high-speed printing, printheads respectively discharging black (K), cyan (C), magenta (M) and yellow (Y) ink tend to have a large number of nozzles. Moreover, in place of multi-pass printing where printing is performed in units of bandwidth corresponding to the length of the nozzle column of a printhead, one-pass one-way printing where image printing is completed by a single scan of a carriage as shown in FIG. 8, or one-pass two-way printing shown in FIG. 9 are becoming common (refer to, e.g., Japanese Patent Application Laid-Open No. 9-226185).

FIGS. 8 and 9 show a printhead unit comprising four heads, each having 256 nozzles, for respectively discharging K, C, M and Y ink.

Furthermore, as printing speed increases, the carriage scanning speed becomes faster. As a result, acceleration and deceleration levels of the carriage tend to increase. Moreover, to meet demands for reduced noise of the printing apparatus, a DC motor is generally employed as a carriage motor.

However, because of the recent trend to downsize the printing apparatus, it is impossible to secure a long distance for carriage acceleration or deceleration. In a case of a printer whose size is constrained like a mobile printer, the acceleration or deceleration distance must be further reduced. In view of this, so-called acceleration/deceleration printing is becoming common. In the acceleration/deceleration printing, a printing operation is performed during acceleration/deceleration of the carriage, i.e., before the carriage reaches its constant speed, so that printing can be performed even in the left and right edges (several millimeters) of a printing medium having a maximum size printable by the printing apparatus. Particularly in a rimless printing mode where an image is printed on all areas of a printing medium, the acceleration/deceleration printing is essential.

However, in the above-described conventional example, since a printing operation is performed during carriage acceleration, the printhead driving current and the carriage-motor driving current reach their peaks at the same time. Depending on the printing density, it is often the case that the driving current reaches the maximum current of the power source that drives the printing apparatus. Particularly, as shown in FIG. 10, a DC motor has a characteristic of requiring a low driving current at the time of high-speed rotation, that is, constant-speed driving, but requires a high driving current at the time of low-speed rotation imposing a large load on the motor, that is, at the time of motor acceleration. Since the time during which the maximum current is generated varies from tens of milliseconds to hundreds of milliseconds depending on the printing conditions, this variation cannot be dealt by the electrolytic capacitor.

In order to supply such large amount of current, the power source capacity must be increased. This causes an increased cost of the power source, resulting in raising the cost of the printing apparatus.

If a current supplied to the DC motor is reduced in order not to increase the power source capacity, the carriage scanning speed declines, resulting in a reduced throughput.

Furthermore, in order to accelerate the carriage to a predetermined speed within a short acceleration/deceleration distance, it is necessary to enlarge the size of the carriage motor so as to improve its acceleration performance. However, this raises a problem of an increased size of the printing apparatus.

SUMMARY OF THE INVENTION

Accordingly, the present invention is conceived as a response to the above-described disadvantages of the conventional art.

For example, a printing apparatus and a printing control method according to the present invention are capable of high-speed printing without enlarging the size of a carriage driving motor and/or a power source.

According to one aspect of the present invention, preferably, a printing apparatus for performing printing on a printing medium by reciprocally scanning a carriage to which a printhead having a plurality of printing elements is mounted, the printing being performed during acceleration, deceleration, and constant-speed movement of the carriage, comprises: a buffer storing print data to be used in a printing operation for one scan; counting means for counting at least a part of the print data, stored in the buffer, which causes the printhead to perform a printing operation during acceleration of the carriage; comparison means for comparing a counted value, counted by the counting means, with a predetermined threshold value; and control means for controlling to change the number of printing elements of the printhead to be used in a printing operation for one scan of the carriage, based on a comparison result of the comparison means.

To be more specific about the configuration of the above-described printing apparatus, it is preferable that the counting means divides the buffer into a plurality of areas, and among the divided plurality of areas, performs counting on an area storing print data to be used by the printhead during acceleration of the carriage.

Furthermore, when the printing apparatus further comprises a DC motor for driving the carriage and a power source for supplying electric power to the printing apparatus, it is preferable that the number of printing elements of the printhead to be used in a printing operation for one scan of the carriage, which is controlled by the control means, satisfies a condition such that the sum of a driving current required for driving the number of printing elements and a driving current supplied to the DC motor for accelerating the carriage is equal to or lower than a capacity of the power source.

Furthermore, in a case where the printing apparatus can be driven by either an AC power source or a battery power source, the apparatus further comprises determining means for determining whether or not the power source is an AC power source or a battery power source. If the determining means determines that the power source is a battery power source, controlling is performed by the control means.

Note that the control means may control to perform multi-pass printing so as to substantially change the number of printing elements of the printhead to b used in a printing operation for one scan of the carriage.

Furthermore, the above-described printing apparatus preferably comprises a printhead which performs printing by an inkjet printing method. The inkjet printhead preferably comprises an electrothermal transducer for generating heat energy to be applied to ink, so as to discharge ink utilizing the heat energy.

According to another aspect of the present invention, preferably, a printing apparatus for performing printing on a printing medium by reciprocally scanning a carriage, to which a printhead having a plurality of printing elements is mounted, by driving force of a carriage motor, the printing being performed during acceleration, deceleration, and constant-speed movement of the carriage, comprises: a buffer storing print data to be used in a printing operation for one scan; counting means for counting at least a part of the print data stored in the buffer, which causes the printhead to perform a printing operation during acceleration of the carriage; acquisition means for acquiring data regarding power consumption of the carriage motor during acceleration or deceleration of the carriage; addition means for adding the data regarding power consumption of the carriage motor acquired by the acquisition means to data regarding power consumption of the printhead which is obtained from a counted value counted by the counting means; comparison means for comparing a value, obtained by the addition means, with a predetermined threshold value; and control means for controlling to change the number of printing elements of the printhead to be used in a printing operation for one scan of the carriage, based on a comparison result of the comparison means.

According to still another aspect of the present invention, preferably, a printing control method adopted for performing printing on a printing medium by reciprocally scanning a carriage to which a printhead having a plurality of printing elements is mounted, the printing being performed during acceleration, deceleration, and constant-speed movement of the carriage, comprises: a storing step of storing into a buffer print data to be used in a printing operation for one scan; a counting step of counting at least a part of the print data, stored in the buffer in the storing step, which causes the printhead to perform a printing operation during acceleration of the carriage; a comparison step of comparing a counted value, counted in the counting step, with a predetermined threshold value; and a control step of controlling to change the number of printing elements of the printhead to be used in a printing operation for one scan of the carriage, based on a comparison result of the comparison step.

According to still another aspect of the present invention, preferably, a printing control method adopted for performing printing on a printing medium by reciprocally scanning a carriage, to which a printhead having a plurality of printing elements is mounted, by driving force of a carriage motor, the printing being performed during acceleration, deceleration, and constant-speed movement of the carriage, comprises: a storing step of storing into a buffer print data to be used in a printing operation for one scan; a counting step of counting at least a part of the print data, stored in the buffer in the storing step, which causes the printhead to perform a printing operation during acceleration of the carriage; an acquisition step of acquiring data regarding power consumption of the carriage motor during acceleration or deceleration of the carriage; an addition step of adding the data regarding power consumption of the carriage motor acquired in the acquisition step to data regarding power consumption of the printhead which is obtained from a counted value counted in the counting step; a comparison step of comparing a value, obtained in the addition step, with a predetermined threshold value; and a control step of controlling to change the number of printing elements of the printhead to be used in a printing operation for one scan of the carriage, based on a comparison result of the comparison step.

The present invention may be provided in the form of a program written in computer-executable codes for causing a computer to execute respective steps of the above-described printing control method.

Furthermore, the program may be provided in the form of a computer-readable storage medium so that it can be read by a computer.

As described above, the present invention can be realized in the form of a program or a storage medium.

In accordance with the present invention as described above, when printing is to be performed on a printing medium by reciprocally scanning a carriage, which incorporates a printhead having a plurality of printing elements, during acceleration, deceleration, and constant-speed movement of the carriage, printing control is performed in the following manner: print data to be used in a printing operation for one scan is stored in a buffer; at least a part of the print data stored in the buffer, which causes the printhead to perform a printing operation during acceleration of the carriage, is counted; the counted value is compared with a predetermined threshold value; and the apparatus is controlled to change the number of printing elements of the printhead to be used in a printing operation for one scan of the carriage, based on the comparison result.

The present invention is particularly advantageous since printing can be performed during acceleration or deceleration of the carriage without enlarging the capacity of the power source.

Furthermore, by virtue of controlling the printing apparatus to change the number of printing elements of the printhead to be used in a printing operation for one scan of the carriage, i.e., by performing multi-pass printing, it is possible to prevent reduction in a throughput of the printing apparatus in ordinary image printing.

Still further, a low-cost compact-size printing apparatus can be provided.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Note that the following embodiment exemplifies a printing apparatus which employs an inkjet printhead.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpret d similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

Figure 1:
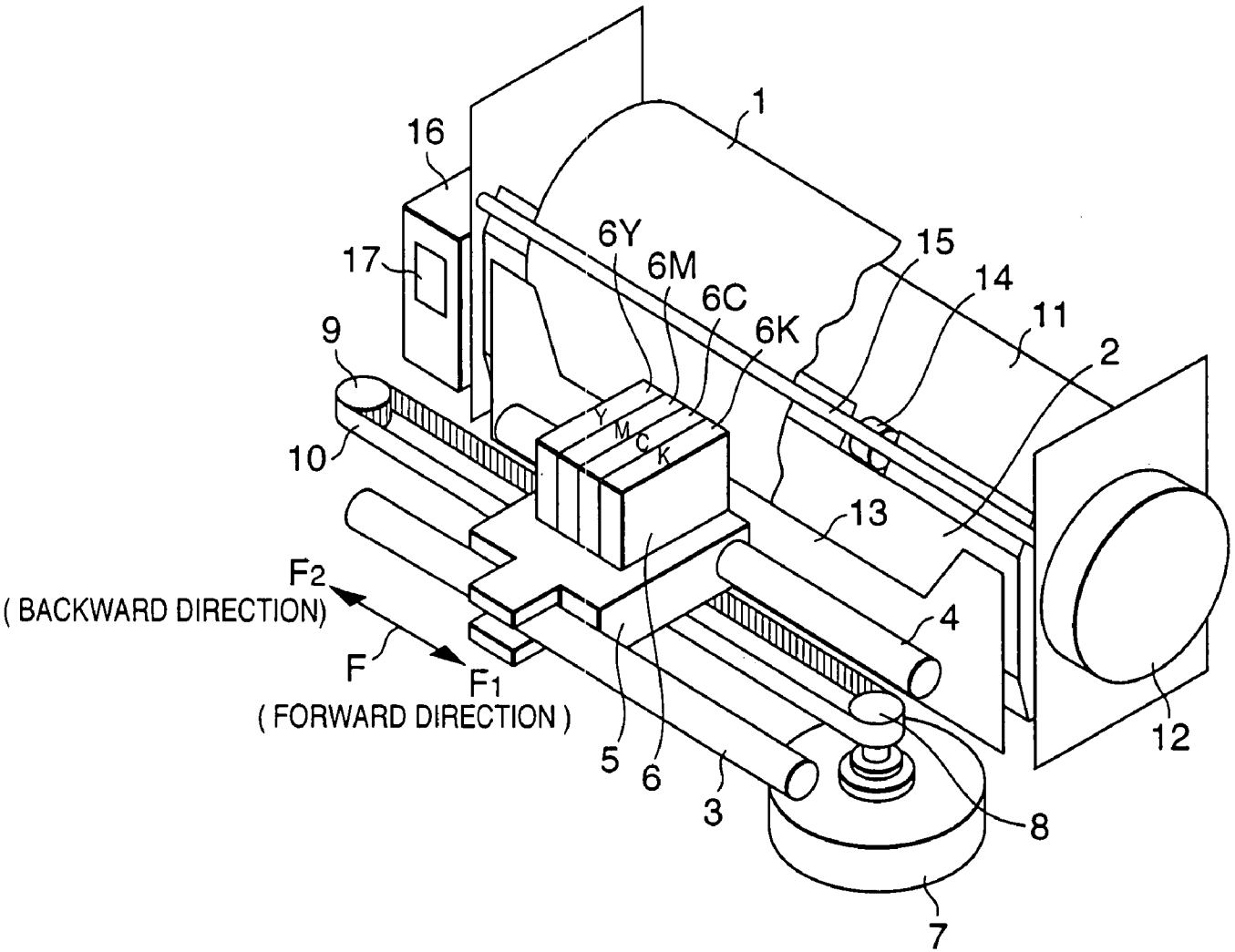
FIG. 1 is a perspective view showing an external appearance of the overall configuration of an inkjet printing apparatus, which serves as a typical embodiment of the present invention.

FIG. 1 is a perspective view showing an external appearance of the main part of a printing apparatus employing a printhead which adopts an inkjet printing method. This printing apparatus serves as a typical embodiment of the present invention.

Referring to FIG. 1, the printing apparatus comprises a carriage 5 which reciprocally moves in the longitudinal direction along guide rails 3 and 4 arranged in parallel with a platen 2 that backs up a printing medium 1 (a sheet-like medium such as printing paper, plastic film or the like). On the carriage 5, a printhead 6 which prints an image on the printing medium 1 according to print data is mounted.

The printhead 6 integrally comprises head units 6K, 6C, 6M and 6Y for respectively discharging black (K), cyan (C), magenta (M) and yellow (Y) ink. Each of the head units has a nozzle column, consisting of 256 nozzles, in the printing-medium conveyance direction (sub-scanning direction). The head units are arranged in order of 6K, 6C, 6M and 6Y with respect to the forward direction (F1) of the carriage reciprocal movement. When the carriage 5 moves in the F1 direction, ink droplets are discharged to the printing medium in order of K ink, C ink, M ink and Y ink, whereas when the carriage 5 moves in the backward direction (F2), ink droplets are discharged to the printing medium in order of Y ink, M ink, C ink and K ink, inversely from the F1 direction.

The carriage 5 is fixed to a timing belt 10, which is wrapped around a pulley 8 and an associated pulley 9 driven by a carriage motor (DC motor) 7. The carriage 5 is reciprocally driven in the main-scanning direction (indicated by arrow F) by rotation of the carriage motor 7. Printing operation is performed in each of the forward and backward paths of the reciprocal movement.

The printing medium 1 is inserted along a paper pan 11 and conveyed to a printing portion located between the printhead 6 and platen 2 by a conveyance roller (not shown) driven by a conveyance motor 12. The printing medium 1 conveyed to the printing portion is attached to the platen (fixed-type flat platen) 2 by a sheet-pressing plate 13. After the printing medium 1 passes through the printing portion, it is conveyed and discharged by a discharge roller 14 and a roller 15, which are driven in synchronization with the conveyance roller (not shown).

A home position is set in the area outside the printing area of the printhead 6. At the home position, a head recovery device 16, comprising a cap 17 and ink suction means, is provided. The cap 17 attaches to or detaches from the ink discharge (orifice) surface of the printhead 6. When the carriage 5 is scanned in the main-scanning direction for performing printing, electrothermal transducers provided in correspondence with respective plural nozzles of the printhead 6 are driven based on print data in synchronization with a signal outputted from a linear encoder 18 (not shown) which is arranged in parallel with the guide rail 4, and ink droplets are discharged from the internal portion of the nozzles to the printing medium 1, thereby forming dot patterns.

Upon completion of the printing, the printhead 6 stops at the home position, and the orifice surface of the printhead 6 is sealed by the cap 17 of the ink recovery device 16.

Figure 2:
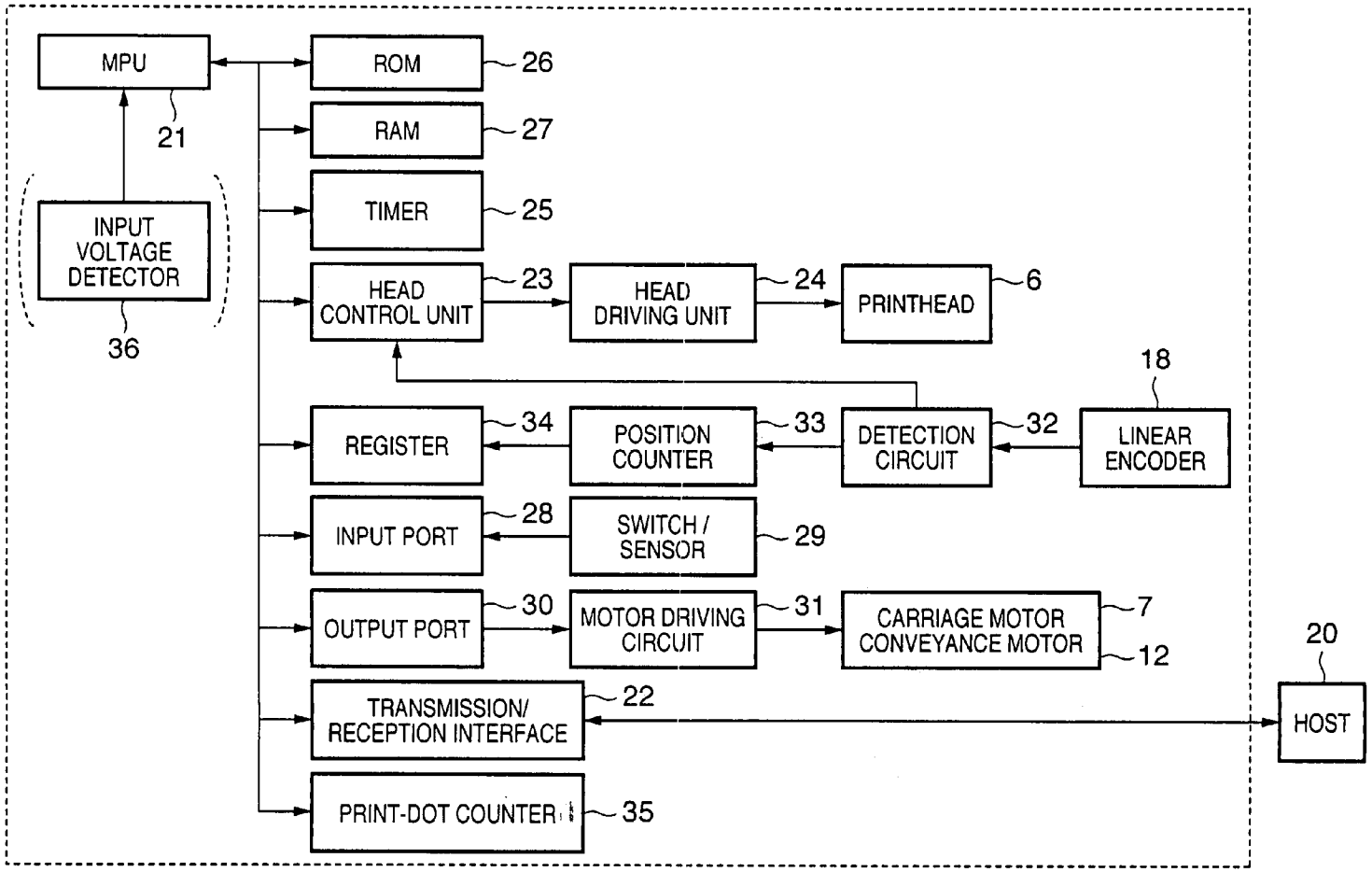
FIG. 2 is a block diagram showing a construction of a control circuit of the inkjet printing apparatus.

FIG. 2 is a block diagram showing a construction of a control circuit of the printing apparatus shown in FIG. 1.

In FIG. 2, an MPU 21 controls the entire printing apparatus in accordance with a program stored in a ROM 26. A transmission/reception interface 22 is provided between the printing apparatus and a host unit 20 for receiving print data. The received data is stored in a reception buffer of RAM 27 by a direct memory access (DMA) controller (not shown) without being intermediated by the MPU 21. If the received print data is compressed data, the received data is subjected to decompression. Then, the data array arranged in the raster direction (carriage main-scanning direction) is converted to a data array arranged in the nozzle-column direction (sub-scanning direction) of the printhead 6 (raster-to-column conversion), and the converted data is stored in a print buffer of the RAM 27. In addition, a timer 25 is connected to the MPU 21 for regulating the timing of the processing.

By the foregoing configuration, the MPU 21 controls rotation of the carriage motor 7, conveyance motor 12 and the like, via an output port 30 and a motor driving circuit 31 based on command data and print data transferred from the host unit 20 as well as various instruction signals inputted from various switches 29 of an operation panel through an input port 28. Also, the MPU 21 reads print data out of the print buffer of the RAM 27 and outputs it to the printhead 6 through a head control unit 23 and a head driving unit 24, thereby controlling the printing operation.

The timer 25 generates various timing signals to be used in a servo sampling period of the carriage motor 7, excitation phase switching of the conveyance motor 12 and the like. An output signal of the linear encoder 18, used, for determining a scanning position and driving timing of the printhead 6, is inputted to a detection circuit 32, through which a direction signal and a count pulse are generated.

The direction signal and count pulse are inputted to a position counter 33, which serves as an up-down counter, and read by the MPU 21 through a register 34 as position information of the printhead 6. The direction signal and count pulse are also inputted to the head control unit 23 and used as a trigger signal for generating a driving pulse for driving the Furthermore, this embodiment comprises a print-dot counter 35. The counter 35 divides both ends of the print buffer into predetermined areas, reads print data out of each area before the print data is used by the printhead, then based on the print data, counts the number of dots that cause the printhead to actually discharge ink, and adds up the counted values. The adding of the print-dot numbers is preferably performed by the DMA controller without an intermediation of the MPU 21 for the purpose of high-speed processing. However, the MPU 21 may execute a program to perform th adding process.

Figure 3:
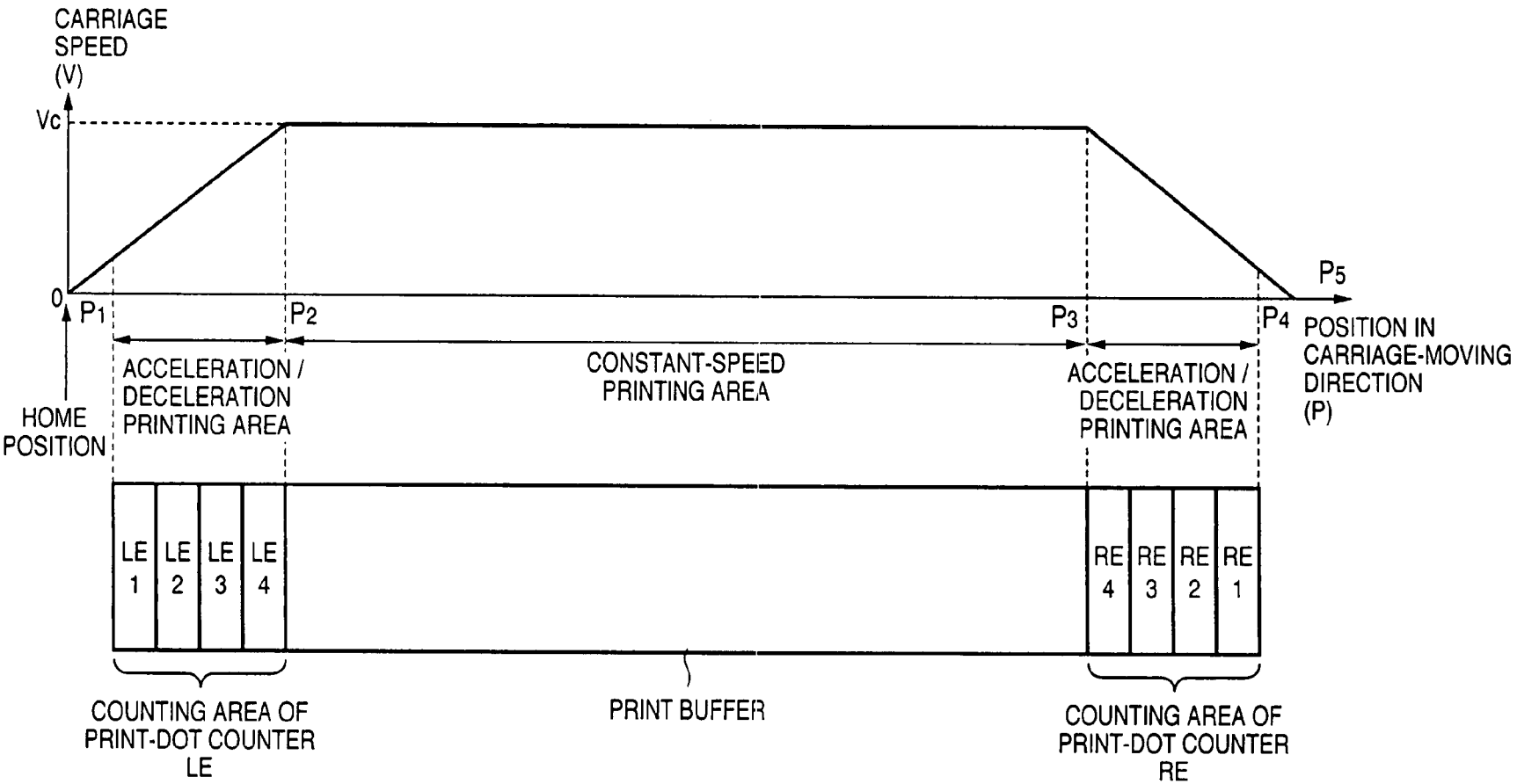
FIG. 3 is a view showing a relation between carriage movement and respective areas of a print buffer counted by a print-dot counter.

FIG. 3 shows a relation between carriage movement and respective areas of the print buffer subjected to counting by the print-dot counter.

Note that, although FIG. 3 shows only one print buffer for ease of explanation, in reality, there are four print buffers for storing print data of respective color components, i.e., K component, C component, M component and Y component.

As shown in FIG. 3, when the carriage 5 at the home position (p=0) starts the reciprocal movement in the forward direction, it accelerates from v=0 to $v=v_c$, and shifts to constant-speed movement when the speed reaches $v=v_c$. The carriage 5 continues the constant-speed movement from $p=P_2$ to $p=P_3$, then decelerates from $p=P_3$, and stops at $p=P_5$. Then, the driving direction is reversed. In the backward direction of reciprocal movement, the carriage 5 accelerates from $p=P_5$ to $p=P_3$, and shifts to constant-speed movement when the speed reaches $v=v_c$. The carriage 5 continues the constant-speed movement from $p=P_3$ to $p=P_2$, then decelerates from $p=P_2$, and stops at p=0.

In the carriage reciprocal motion according to this embodiment, printing is performed not only in the constant-speed area, but also in the acceleration/deceleration area on both ends shown in FIG. 3. The acceleration/deceleration area corresponds to the carriage position of $P_1 \leqq p \leqq P_2$ and $P_3 \leqq p \leqq P_4$.

In correspondence with the acceleration/deceleration printing area and constant-speed printing area, a print buffer is provided as shown in FIG. 3.

In the present embodiment, the areas LE and RE on both ends of the print buffer shown in FIG. 3 are the counting-target area of the print-dot counter 35. The areas LE and RE are respectively divided into a plurality of predetermined areas (in FIG. 3, the areas are divided into four areas respectively: LE1 to LE4 and RE1 to RE4). Based on the print data stored in each of the divided areas, the print-dot counter 35 counts the number of dots (number of print dots) that cause the printhead 6 to discharge ink, and adds up the counted values.

Herein, if the number of print dots of the entire acceleration/deceleration printing area is to be used for printing control, the counted values for all the LE1 to LE4 and RE1 to RE4 are added. If the number of print dots of a part of the areas is to be used, at least one from the LE1 to LE4 and at least one from RE1 to RE4 are used.

The foregoing control enables to obtain the total number of print dots (TC) generated with respective colors of ink in the entire or a part of the areas during acceleration of th carriage 5. When the total number of dots is equal to or larger than asset value (A), the present embodiment confines the number of nozzles to be used in one scan of the carriage within a predetermined constant value. By virtue of this, it is possible to keep the total peak values of the printhead driving current and the carriage-motor driving current under a set value.

Next, printing control executed by the printing apparatus having the above-described configuration is described.

Figure 4:
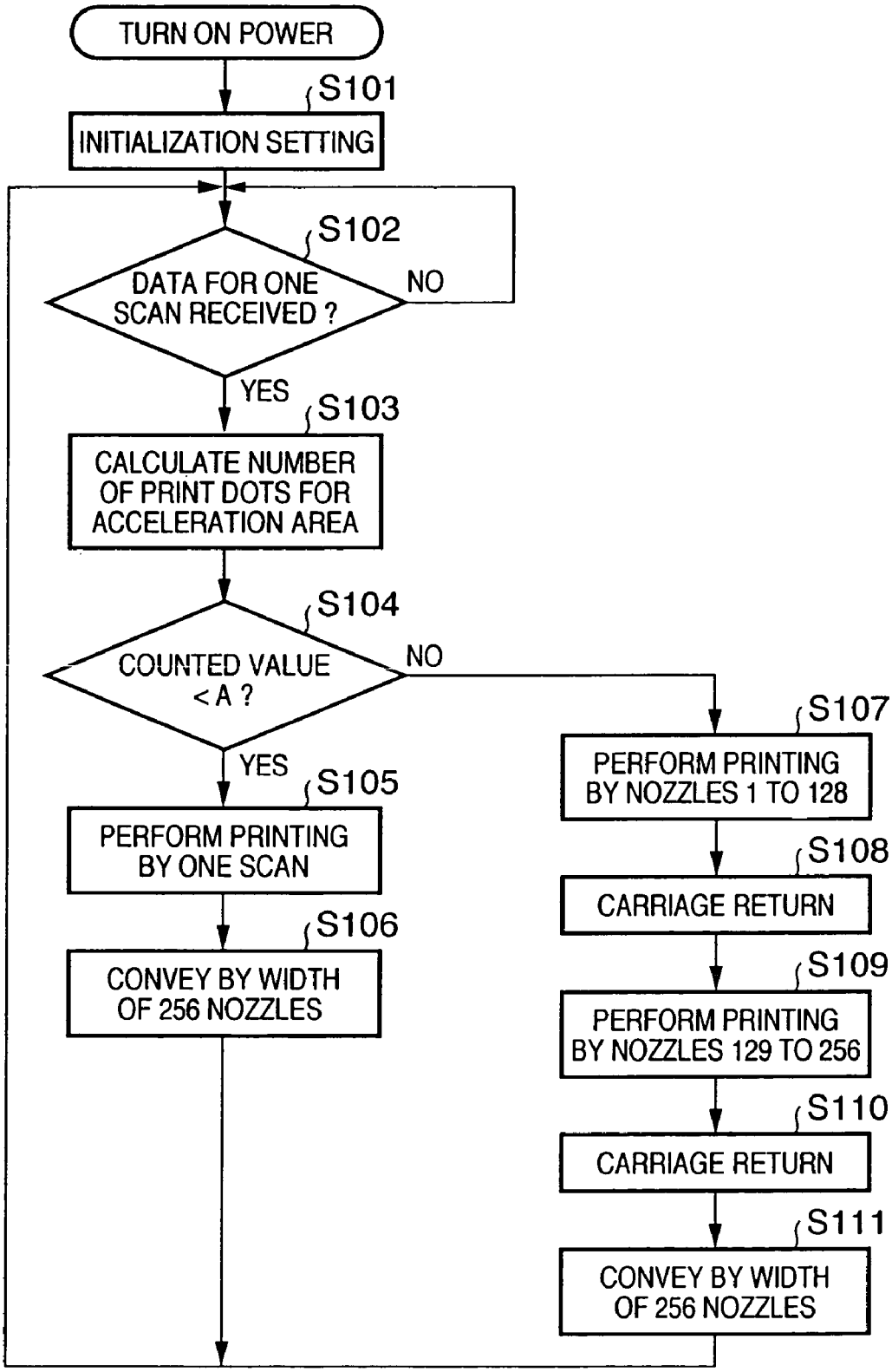
FIG. 4 is a flowchart showing a printing control procedure of the inkjet printing apparatus.

FIG. 4 is a flowchart showing a printing control procedure.

Note that the printing apparatus used as an example in this embodiment comprises the printhead 6 mentioned above, which integrally comprises head units 6K, 6C, 6M and 6Y for respectively discharging black (K), cyan (C), magenta (M) and yellow (Y) ink. Each of the head units has a nozzle column, consisting of 256 nozzles, in the sub-scanning direction.

Upon turning on the power of the printing apparatus, initialization setting is performed in the apparatus in step S101.

When the printhead 6 mounted on the carriage 5 is at the home position, the position counter 33 is initialized to "0

(zero)". Thereafter, each time the linear encoder 18 inputs a rising edge of one of the two signals having phases that are shifted by 90°, the position counter 33 updates the counted value (position of the printhead 6). The counter value indicates the absolute position of the printhead.

In step S102, print data for 256 nozzles arranged in the sub-scanning direction is inputted from the host unit 20, and stored as print data in the print buffer of the RAM 27. In step S103, the print-dot counter 35 counts the number of print dots of respective color components to be printed in the acceleration area of the carriage 5, which corresponds to the few-millimeter areas on the left and right edges of printing paper.

In step S104, the total counted value (TC) is compared with the set value (A). If TC<A stands, it is determined that the printing density in the carriage acceleration area is low and that adding up the carriage-motor driving current and printhead driving current during acceleration will fall within the capacity of the printer power source. Then, the control proceeds to step S105.

In step S105, the carriage 5 is scanned to perform printing in the so-called one-pass two-way printing mode, where all the 256 nozzles of the printhead are used for respective colors in one scan of the carriage. In step S106, the printing medium is conveyed by a width corresponding to the printing width of 256 nozzles. Then, the control returns to step S102 to repeat the foregoing processes.

On th contrary, if TC≧A stands in step S104, it is determined that the printing density in the carriage acceleration area is high and that adding up the carriage-motor driving current and printhead driving current during acceleration will exceed the capacity of the printer power source. Then, the control proceeds to step S107.

Figure 5:
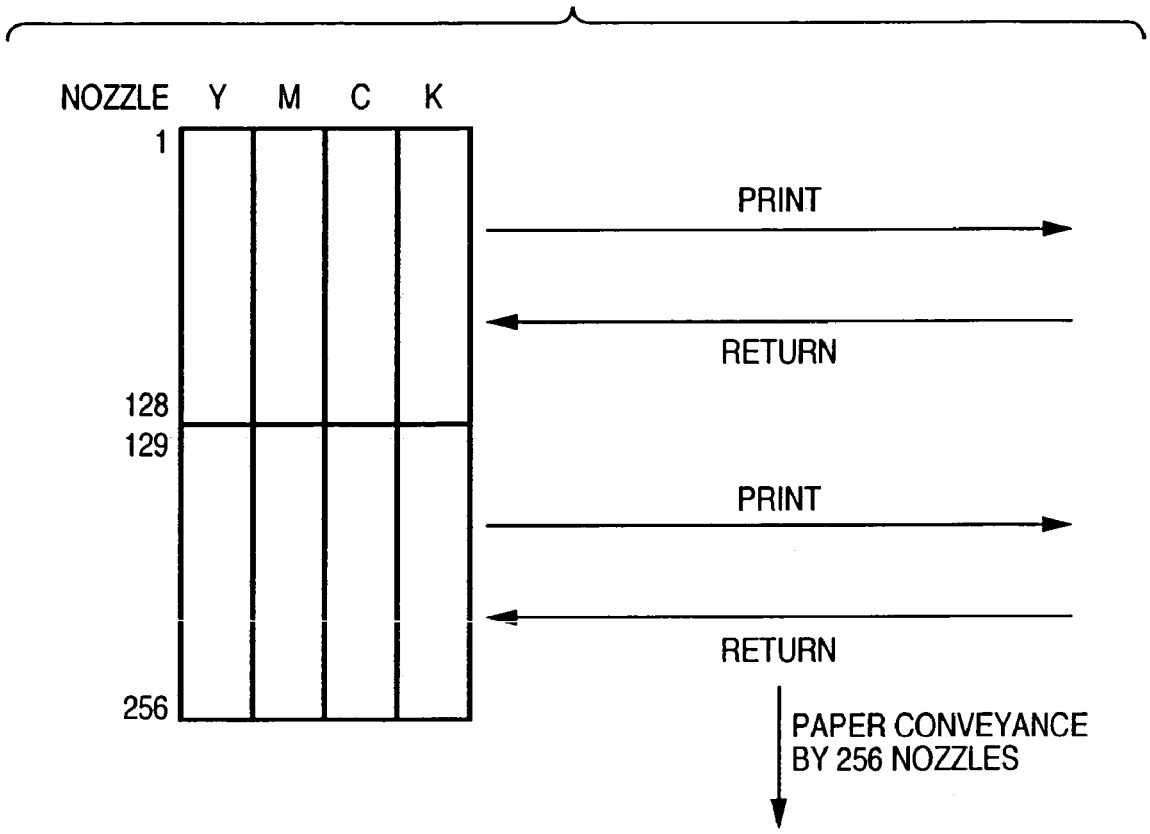
FIG. 5 is a view showing, as an example, scanning of a printhead.

In steps S107 to S110, 256 nozzles of each head unit are divided in half for printing respective colors as shown in FIG. 5, and printing is performed without conveying the printing medium. More specifically, in step S107, nozzles 1 to 128 which are the top half of each head unit are used for performing printing in carriage scanning of the forward direction. Upon completion of this printing, in step S108, the carriage 5 is returned without performing a printing operation. In step S109, nozzles 129 to 256 which are the bottom half of each head unit are used for printing. In step S110, the carriage 5 is returned. In the foregoing manner, it is controlled to use all the 256 nozzles of each head unit in two times of scanning. By virtue of this control, the printhead driving current during acceleration of the carriage can be cut down in half.

Upon completion of the printing for the width of 256 nozzles, the printing medium is conveyed by a width corresponding to the printing width of 256 nozzles in step S111. Then, the control returns to step S102 to repeat the foregoing processes.

According to the printing apparatus described in the foregoing embodiment which performs printing during acceleration/deceleration of the carriage, it is possible to change the number of nozzles of the printhead used in one scan of the carriage in accordance with a printing density of the carriage acceleration area.

Note in the above-described embodiment, printing for the width of 256 nozzles is realized by dividing the 256 nozzles of each head unit in half, then performing printing using 128 nozzles of each head unit in one scan of the carriage and returning the carriage without conveying the printing medium, then repeating this operation one more time. However, the present invention is not limited to this.

Figure 6:
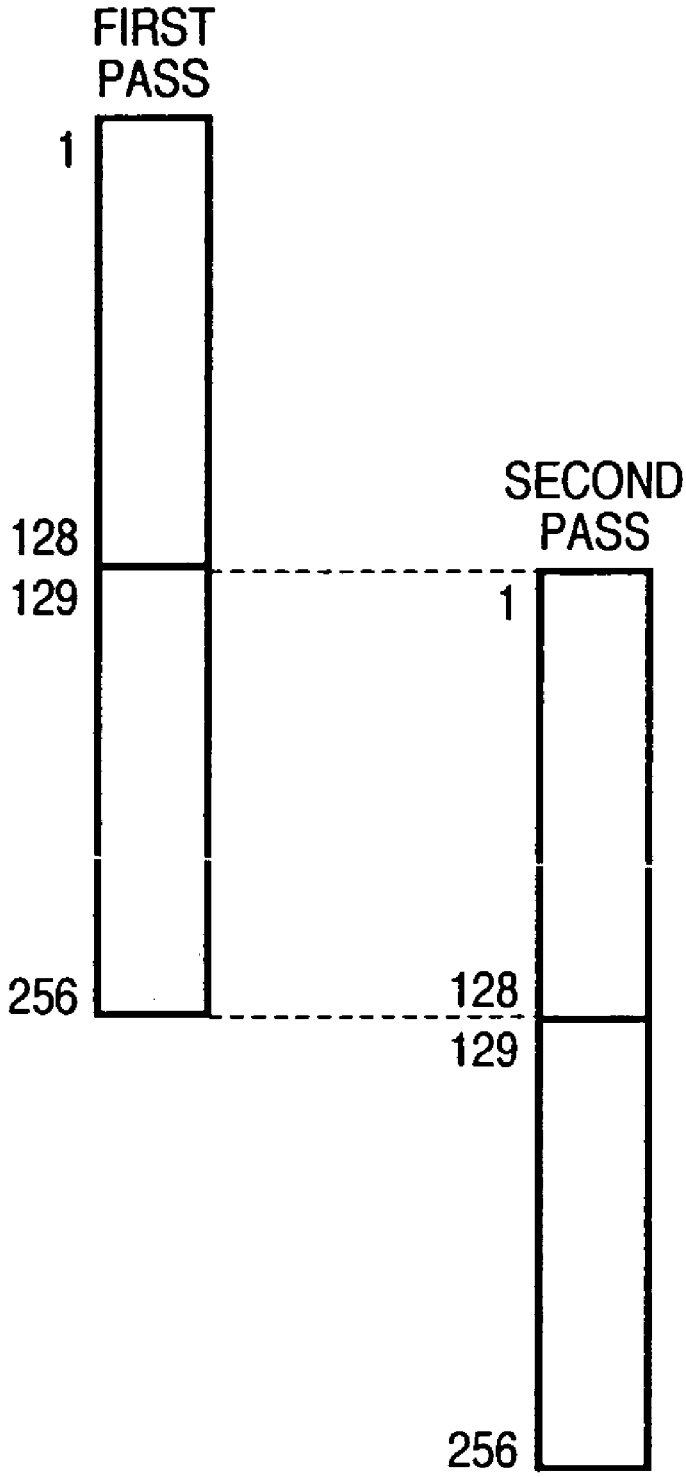
FIG. 6 is a view showing movement of a printhead performing multi-pass (two-pass) printing.

For instance, as shown in FIG. 6, it may be controlled such that 256 nozzles of the printhead are divided in half and the divided nozzle block is used as a unit length for conveying the printing medium in the sub-scanning direction. In other words, a so-called multi-pass printing may be performed by reciprocally scanning the printhead two times in the main-scanning direction and printing an image corresponding to a width (one band) that can be printed by one scan of the printhead while employing different mask patterns for each scan. Multi-pass printing achieves improved printing quality without hardly changing th printing time for one page of printing medium, compared to the above-described printing method.

Furthermore, although the present embodiment specifies that the area where the number of print dots is added is the entire carriage acceleration printing area, it may be confined to the area where the carriage-motor driving current is equal to or larger than a set value. This enables to minimize reduction in a throughput of the printing apparatus. To realize this control, each of the divided areas in the counting-target area is subjected to comparison with a predetermined set value, and in accordance with the comparison result, the number of nozzles of the printhead used in one scan of the carriage is changed.

Furthermore, in the above-described embodiment, the number of nozzles to be used or the number of times of scanning necessary to form the bandwidth is changed in accordance with the total number of print dots in the entire or a part of the areas printed in one scan of the carriage during acceleration of the carriage. However, the number of nozzles to be used or the number of times of scanning may be changed when the number of simultaneously driven printing elements and the number of consecutively driven printing elements exceed a set value in the printhead and there is printing data in the areas. This is an effective way for the printing apparatus to solve the problem of reaching the current peak value of the power source.

[Other Embodiment]

Hereinafter, a description is provided on printing control for a case where the printing apparatus having the configuration shown in FIGS. 1 to 3 can be driven by an AC power source or batteries.

Figure 7:
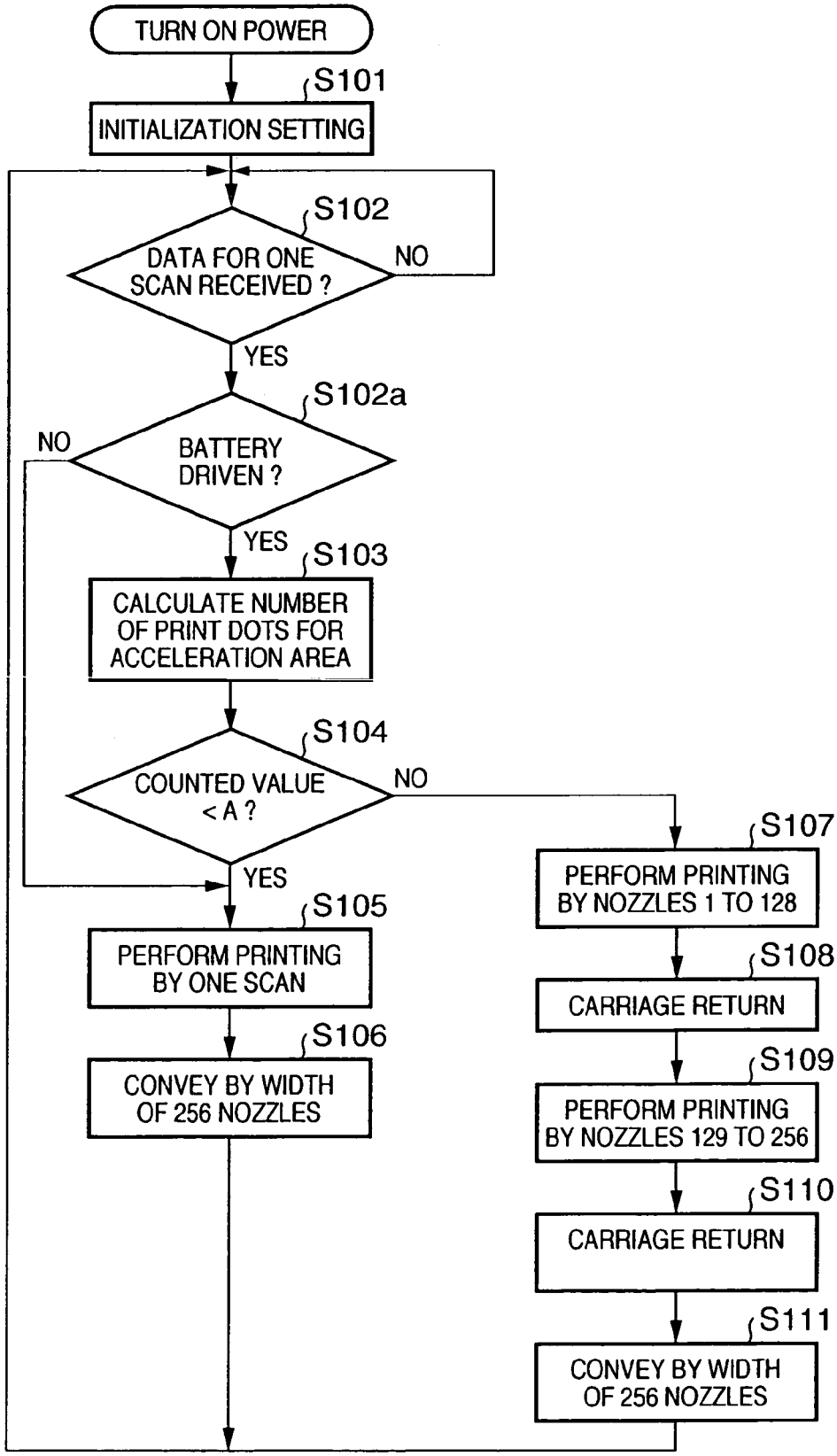
FIG. 7 is a flowchart showing a printing control procedure according to another embodiment of the present invention.
Figure 8:
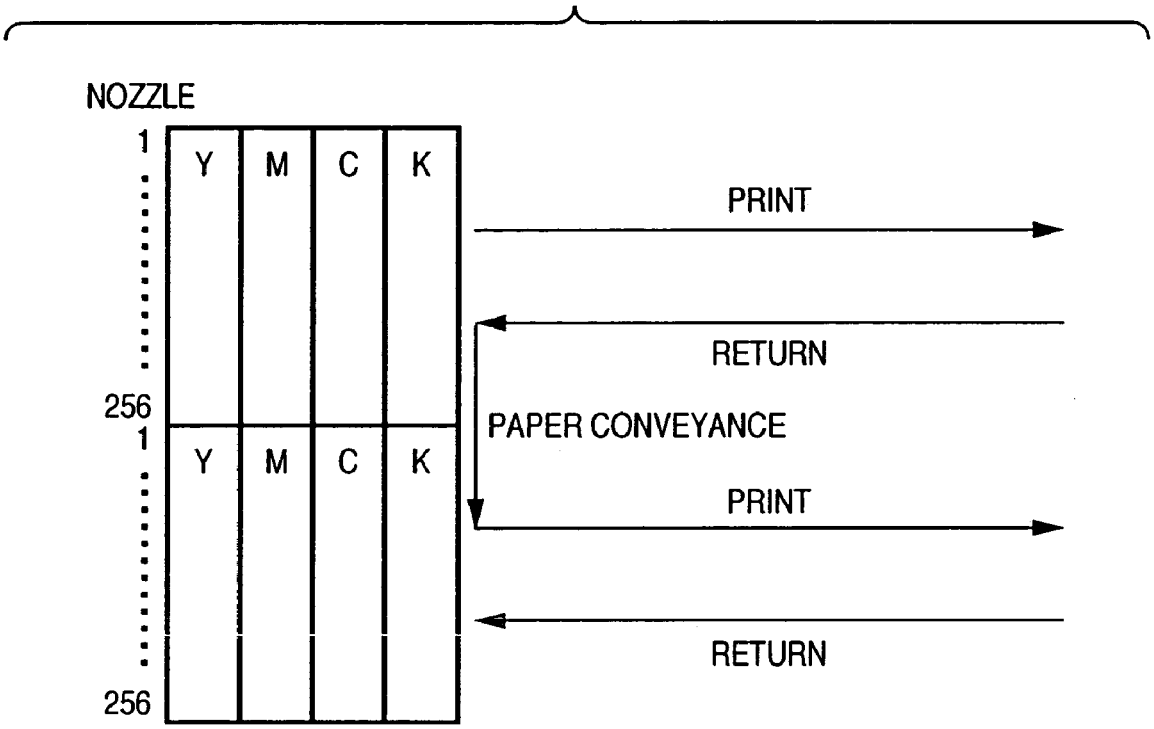
FIG. 8 is a view showing, as an example, scanning of a printhead performing one-pass one-way printing.
Figure 9:
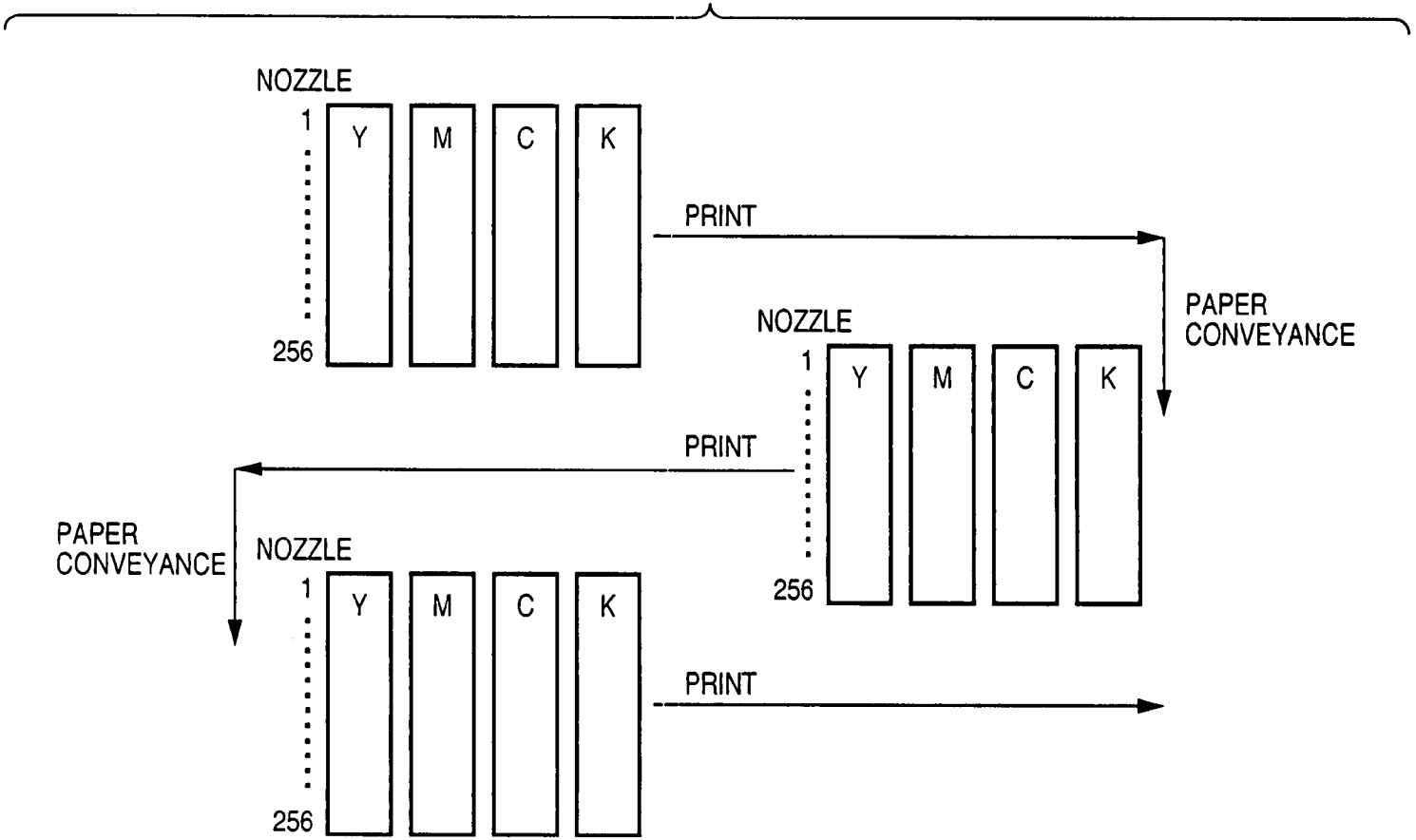
FIG. 9 is a view showing, as an example, scanning of a printhead performing one-pass two-way printing.
Figure 10:
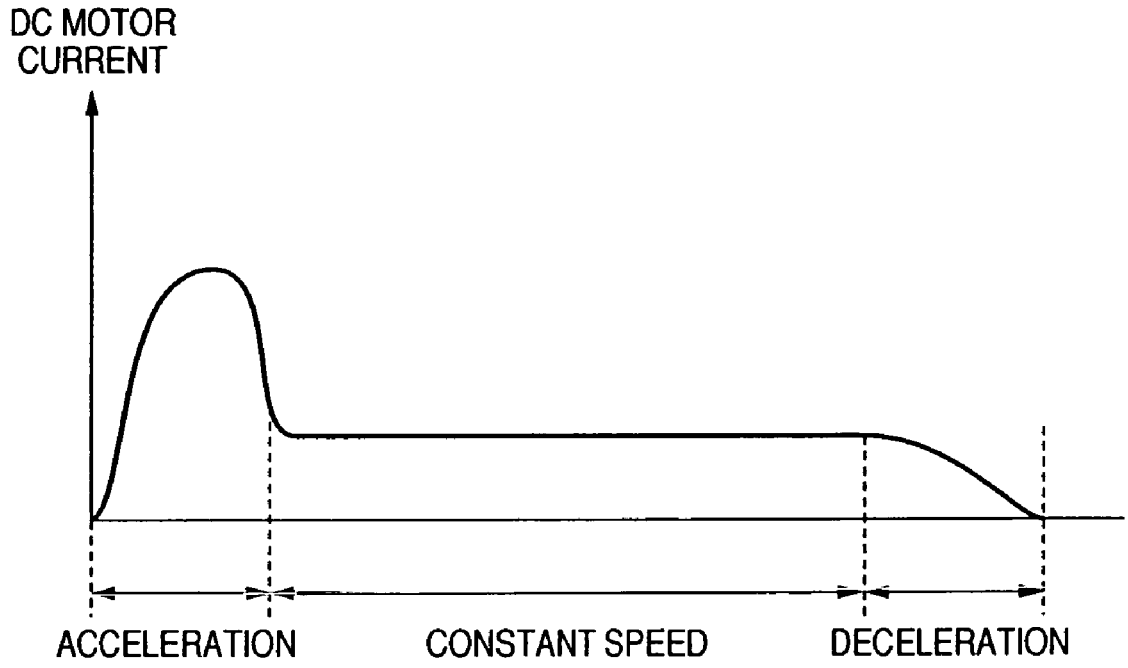
FIG. 10 is a current waveform chart of a carriage motor (DC motor) employed in the inkjet printing apparatus.

FIG. 7 is a flowchart showing a printing procedure according to this embodiment. Note in FIG. 7, with respect to steps identical to the steps described in FIG. 4, the same step numbers are assigned and descriptions thereof are omitted. Only a characteristic process of this embodiment will be described.

Referring to the flowchart in FIG. 7, after processing in steps S101 and S102 is completed, it is determined in step S102*a* whether or not the printing apparatus in use is driven by an AC power source or batteries (generally determined by the difference in voltage values inputted to the apparatus). An input voltage detector 36 shown in FIG. 2 checks the inputted voltage value and transmits the detection result to the MPU 21 as a digital signal, then the MPU 21 makes the determination.

If it is determined that the apparatus is driven by an AC power source, the control proceeds to step S105 and the same processing as that described in FIG. 4 is executed. On the contrary, if it is determined that the apparatus is driven by batteries, the control proceeds to step S103 and the same processing as that described in FIG. 4 is executed.

According to this embodiment proposing a printing apparatus which performs printing during acceleration/deceleration of the carriage, only when the printing apparatus is driven by batteries, it is possible to change the number of nozzles of the printhead used in one scan of the carriage in accordance with a printing density of the carriage acceleration area. By virtue of this control, when the printing apparatus is driven by an AC power source having some margins in the capacity of the power source, printing can be performed without reducing a throughput, whereas when the printing apparatus is driven by batteries, printing can be performed while taking the current capacity of the internal power source (DC—DC converter) into consideration.

Accordingly, it is possible to prevent unnecessary increase in the current capacity of the internal power source (DC-DC converter), which causes an increased size and cost of the apparatus.

[Still Other Embodiment]

Besides the above-described embodiments, the following configuration can be adopted.

Figure 11:
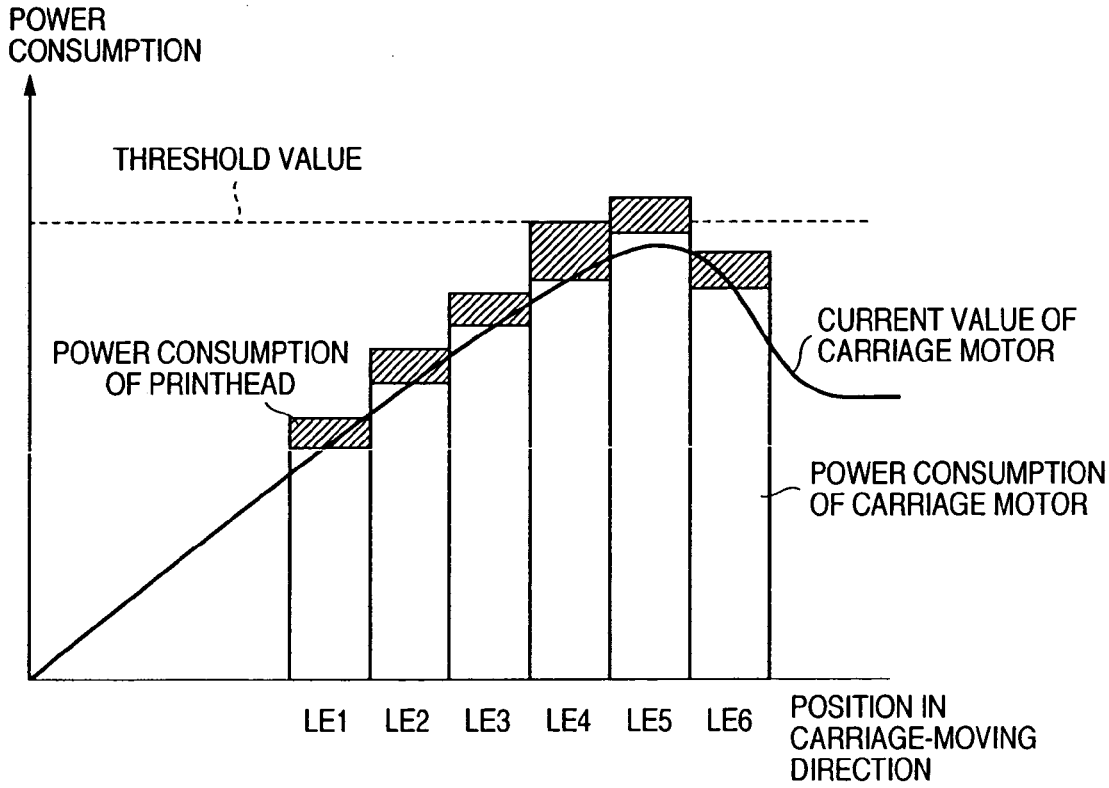
FIG. 11 is a graph showing how the total power consumption of the printhead and carriage motor varies in the carriage moving direction.

FIG. 11 shows how the total power consumption (driving current) of the printhead and carriage motor varies in the carriage moving direction.

FIG. 11 particularly shows variations in the total power consumption for each of the small printing areas. The power consumption of the printhead can be obtained by counting the amount of print data. By virtue of this, even in a case the print data in the carriage acceleration area (or deceleration area) is unequally distributed, it is possible to obtain in detail the timing at which the total power consumption of the carriage motor and printhead reaches a peak.

More specifically, a typical current consumption value of the carriage motor in the carriage acceleration area can be obtained in advance. For instance, data regarding the power consumption in each of the carriage acceleration/deceleration areas indicated by LE1 to LE6 in FIG. 11 and data regarding the power consumption obtained from the total number of print dots (TC) for respective colors of ink in respective areas of LE1 to LE6 are summed up for each of the areas LE1 to LE6, and it is determined whether or not the summed value exceeds a predetermined value (threshold value).

The foregoing control is realized by the following processes. For instance, in step S103 of the flowchart shown in FIG. 4 or 7, the total power consumption of each area is obtained. In step S104, the total power consumption is compared with the threshold value with respect to each area. In the comparison performed with respect to each area, if there is at least one area where the total power consumption exceeds the threshold value, the control proceeds to step S107.

Note that the peak of the carriage-motor power consumption (peak of the driving current) may be different between the case where the carriage is moved in the forward direction and the case where the carriage is moved in the backward direction.

Figure 12:
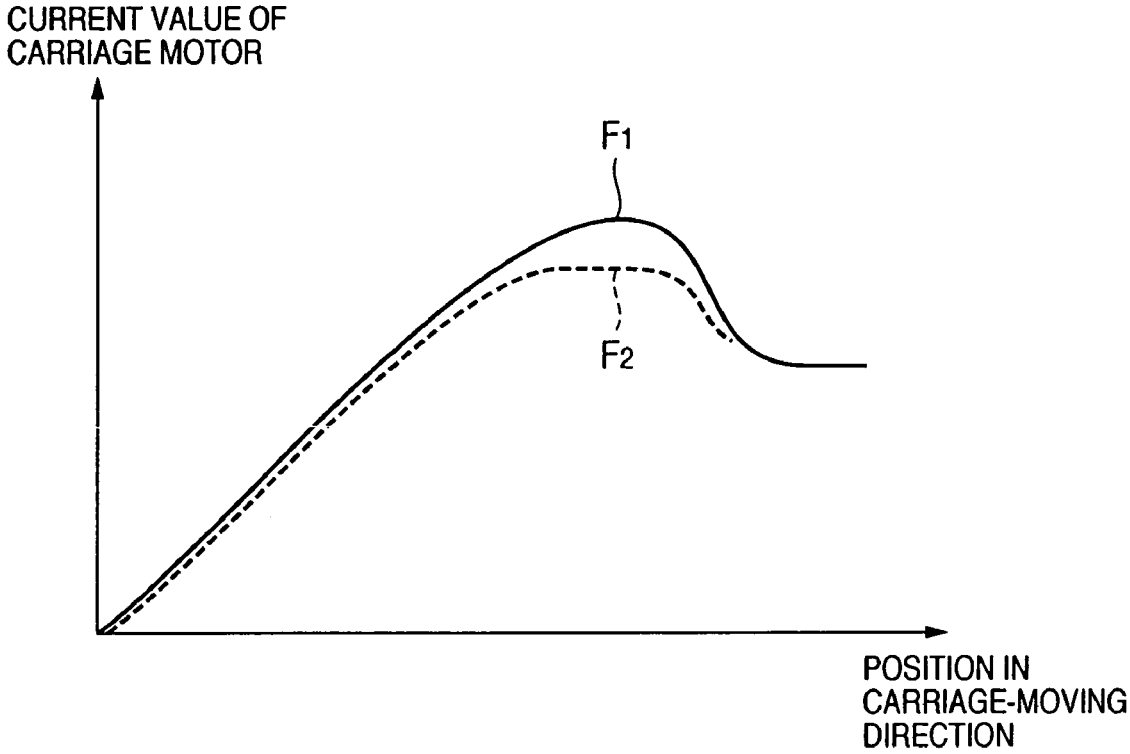
FIG. 12 is a graph showing variations in the carriage-motor power consumption, which depends upon the moving direction of the carriage.

FIG. 12 shows variations in the carriage-motor power consumption, which depends upon the moving direction of the carriage.

In FIG. 12, F1 shows a variation in the power consumption in a case where the carriage is moved in the forward direction, and F2 shows a variation in the power consumption in a case where the carriage is moved in the backward direction. As is apparent from comparison between F1 and F2, although the pattern of variations in the power consumption is similar, the peak of the power consumption is higher in a case where the carriage is moved in the forward direction than a case where the carriage is moved in the backward direction. This difference is generated because a torque required for accelerating th carriage in the forward direction differs from that of the backward direction depending on, e.g., the configuration of the carriage driving means.

To cope with such case, this embodiment performs controlling to change the threshold value in accordance with the carriage moving direction.

The foregoing control of changing the threshold value is also effectively applicable to a case where printing is performed while changing the carriage scanning direction in accordance with print data, to reduce printing time.

Note that in the above embodiments, the liquid discharged from the printhead has been described as ink, and the liquid contained in the ink tank has been described as ink. However, the liquid is not limited to ink. For example, the ink tank may contain processed liquid or the like discharged to a print medium to improve fixability or water repellency of a printed image or to increase the image quality.

The embodiments described above comprise means (e.g., an electrothermal transducer, laser beam generator, and the like) for generating heat energy as the energy utilized upon execution of ink discharge, and adopts the method which causes a change in state of ink by the heat energy, among the inkjet printing method. According to this printing method, a high-density, high-precision printing operation can be attained.

As the typical arrangement and principle of the inkjet printing system, one practiced by use of the basic principle disclosed in, for example, U.S. Pat. Nos. 4,723,129 and 4,740,796 is preferable. The above system is applicable to either one of so-called an on-demand type or a continuous type. Particularly, in the case of the on-demand type, the system is effective because, by applying at least one driving signal, which corresponds to printing information and causes a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

Furthermore, although the above embodiments have described a serial-type printing apparatus which performs printing by scanning a printhead, a printing apparatus which employs a full-line type printhead having a length corresponding to the width of a maximum printing medium printable by the printer may be used. As a full-line type printhead, either the arrangement which satisfies the full-line length by combining a plurality of printheads as disclosed in the above specification or the arrangement as a single printhead obtained by forming printheads integrally can be used.

In addition, not only a cartridge type printhead in which an ink tank is integrally arranged on the printhead itself, but also an exchangeable chip type printhead, which can be electrically connected to the apparatus main unit and can receive ink from the apparatus main unit upon being mounted on the apparatus main unit, may be applied to the present invention.

It is preferable to add recovery means for the printhead, preliminary means and the like to the above-described configuration of the printing apparatus since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independent of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ ink which is solid at room temperature or less, or ink which softens or liquefies at room temperature, or ink which liquefies upon application of a printing signal, since it is a general practice to perform temperature control of the ink itself within a range from 30° C. to 70° C. in the inkjet system, so that the ink viscosity can fall within a stable discharge range.

Furthermore, the printing apparatus according to the present invention may be provided as an integral or stand-alone image output unit of a data processing apparatus, e.g., a computer, or a copying machine combined with a reader, or a facsimile apparatus having a transmission/reception function.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for performing printing on a printing medium by reciprocally scanning a carriage to which a printhead having a plurality of printing elements is mounted, said printing being performed during acceleration, deceleration, and constant-speed movement of the carriage, said apparatus comprising:

a buffer storing print data to be used in a printing operation for one scan;

counting means for counting at least a part of the print data, stored in said buffer, which causes the printhead to perform a printing operation during acceleration of the carriage;

comparison means for comparing a counted value, counted by said counting means, with a predetermined threshold value;

control means for controlling to change a number of printing elements of the printhead to be used in a printing operation for one scan of the carriage, based on a comparison result of said comparison means;

a DC motor for driving the carriage;

a power source for supplying electric power to the printing apparatus; and determination means for determining whether or not the power source is an AC power source or a battery power source, wherein the number of printing elements of the printhead to be used in a printing operation for one scan of the carriage, which is controlled by said control means, satisfies a condition such that a sum of a driving current required for driving the number of printing elements and a driving current supplied to the DC motor for accelerating the carriage is equal to or lower than a capacity of the power source, and wherein, in a case in which it is determined by said determination means that the power source is a battery power source, controlling is performed by said control means, and in a case in which it is determined by said determination means that the power source is an AC power source, the counting by said counting means, the comparing by said comparison means, and the controlling by said control means are skipped.

2. The apparatus according to claim 1, wherein said counting means divides said buffer into a plurality of areas, and among the divided plurality of areas, performs counting on an area storing print data to be used by the printhead during acceleration of the carriage.

3. The apparatus according to claim 1, wherein said control means controls to perform multi-pass printing.

4. The apparatus according to claim 1, wherein the printhead is an inkjet printhead which performs printing by discharging ink.

5. The apparatus according to claim 4, wherein said inkjet printhead comprises an electrothermal transducer for generating heat energy to be applied to ink, so as to discharge ink utilizing the heat energy.

6. The apparatus according to claim 1, further comprising:

acquisition means for acquiring data regarding power consumption of the DC motor during acceleration or deceleration of the carriage; and addition means for adding the data regarding power consumption of the DC motor acquired by said acquisition means to data regarding power consumption of the printhead which is obtained from a counted value counted by said counting means, wherein said comparison means compares a value, obtained by said addition means, with a second predetermined threshold value.

7. The apparatus according to claim 6, wherein said comparison means changes the second predetermined threshold value in accordance with a moving direction of the carriage.

8. A printing control method for use by a printing apparatus to perform printing on a printing medium by reciprocally scanning a carriage driven by a DC motor to which a printhead having a plurality of printing elements is mounted, said printing being performed during acceleration, deceleration, and constant-speed movement of the carriage, said method comprising:

a storing step of storing into a buffer print data to be used in a printing operation for one scan;

a counting step of counting at least a part of the print data, stored in the buffer in said storing step, which causes the printhead to perform a printing operation during acceleration of the carriage;

a comparison step of comparing a counted value, counted in said counting step, with a predetermined threshold value;

a control step of controlling to change a number of printing elements of the printhead to be used in a printing operation for one scan of the carriage, based on a comparison result of said comparison step; and a determination step of determining whether or not the power source for supplying electric power to the printing apparatus is an AC power source or a battery power source, wherein the number of printing elements of the printhead to be used in a printing operation for one scan of the carriage, controlled in said control step, satisfies a condition such that a sum of a driving current required for driving the number of printing elements and a driving current supplied to the DC motor for accelerating the carriage is equal to or lower than a capacity of the power source, and wherein, in a case in which it is determined in said determination step that the power source is a battery power source, controlling in said control step is performed, and in a case in which it is determined in said determination step that the power source is an AC power source, the counting in said counting step, the comparing in said comparison step, and the controlling in said control step are skipped.

* * * * *

UNITED STATES PATENT AND TRADEMARK OFFICE

CERTIFICATE OF CORRECTION

PATENT NO. : 7,207,644 B2
APPLICATION NO. : 10/706941
DATED : April 24, 2007
INVENTOR(S) : Kaburagi It is certified that error appears in the above-identified patent and that said Letters Patent is hereby corrected as shown below:

COLUMN 1:
Line 50, “us d” should read --used--.

COLUMN 3:
Line 40, “b” should read --be--.

COLUMN 6:
Line 11, “interpret d” should read --interpreted--.

COLUMN 7:
Line 54, “the Furthermore,” should read --the printhead 6. ¶ Furthermore,--.

COLUMN 8:
Line 46, “asset” should read --a set--.

COLUMN 9:
Line 28, “th” should read --the--.

COLUMN 10:
Line 11, “th” should read --the--.

COLUMN 11:
Line 65, “th” should read --the--.

Signed and Sealed this

Third Day of March, 2009

JOHN DOLL
*Acting Director of the United States Patent and Trademark Office*